US008649150B2

(12) United States Patent
Buxton

(10) Patent No.: US 8,649,150 B2
(45) Date of Patent: Feb. 11, 2014

(54) SOLENOID PROTECTION CIRCUIT

(75) Inventor: Keith Buxton, Nottingham (GB)

(73) Assignee: Videojet Technologies Inc., Wood Dale, IL (US)

( * ) Notice: Subject to any disclaimer, the term of this patent is extended or adjusted under 35 U.S.C. 154(b) by 387 days.

(21) Appl. No.: 12/959,219

(22) Filed: Dec. 2, 2010

(65) Prior Publication Data

US 2012/0106019 A1 May 3, 2012

Related U.S. Application Data

(60) Provisional application No. 61/408,859, filed on Nov. 1, 2010.

(51) Int. Cl.
*H01H 47/22* (2006.01)

(52) U.S. Cl.
USPC ..... 361/152

(58) Field of Classification Search
USPC ..... 361/152
See application file for complete search history.

(56) References Cited

U.S. PATENT DOCUMENTS

| | | | | | |
|---|---|---|---|---|---|
| 3,399,342 | A * | 8/1968 | Fligel | 324/540 |
| 3,618,417 | A * | 11/1971 | Brown | 74/365 |
| 4,207,602 | A * | 6/1980 | Kussy et al. | 361/24 |
| 4,409,639 | A | 10/1983 | Wesner | |
| 4,597,025 | A * | 6/1986 | Rutchik et al. | 361/94 |
| 4,958,269 | A * | 9/1990 | Gritter | 700/33 |
| 5,021,955 | A | 6/1991 | Ito | |
| 5,204,802 | A | 4/1993 | Howes, Jr. | |
| 5,621,604 | A | 4/1997 | Carlson | |
| 6,104,583 | A * | 8/2000 | Wynn et al. | 361/7 |
| 6,164,125 | A | 12/2000 | Kawase | |
| 7,256,977 | B2 * | 8/2007 | Nakata | 361/117 |
| 7,746,617 | B2 * | 6/2010 | Kamiyama et al. | 361/115 |
| 2001/0023876 | A1 | 9/2001 | Estelle et al. | |
| 2004/0122616 | A1 * | 6/2004 | Kumar et al. | 702/148 |
| 2008/0232015 | A1 | 9/2008 | Wakabayashi | |
| 2009/0027817 | A1 * | 1/2009 | Kamiyama et al. | 361/71 |
| 2010/0116595 | A1 * | 5/2010 | Kang et al. | 187/289 |

FOREIGN PATENT DOCUMENTS

| | | | | |
|---|---|---|---|---|
| EP | 1944169 | | 1/2008 | |
| GB | 2206754 | | 1/1989 | |
| GB | 2367962 | | 4/2012 | |
| JP | 08125803 | * | 5/1996 | H04N 1/00 |

* cited by examiner

*Primary Examiner* — Rexford Barnie
*Assistant Examiner* — Angela Brooks

(57) ABSTRACT

A system prevents solenoids from overheating. The solenoid circuit has solenoids connected across a power supply. Control switches energize the solenoids by controllably connecting the solenoids to and from the power source. The protection system includes a master switch connected between the power source and the solenoids for simultaneously connecting and disconnecting all of the solenoids with the power source. A current sensor is positioned between the supply terminal of the power supply and the solenoids for detecting a current flowing between the supply and any of the solenoids and for producing a current-sensed signal. A controller detects abnormalities based on the current-sensed signal and responsively opens the master switch to disconnect all of the solenoids from the power source.

22 Claims, 7 Drawing Sheets

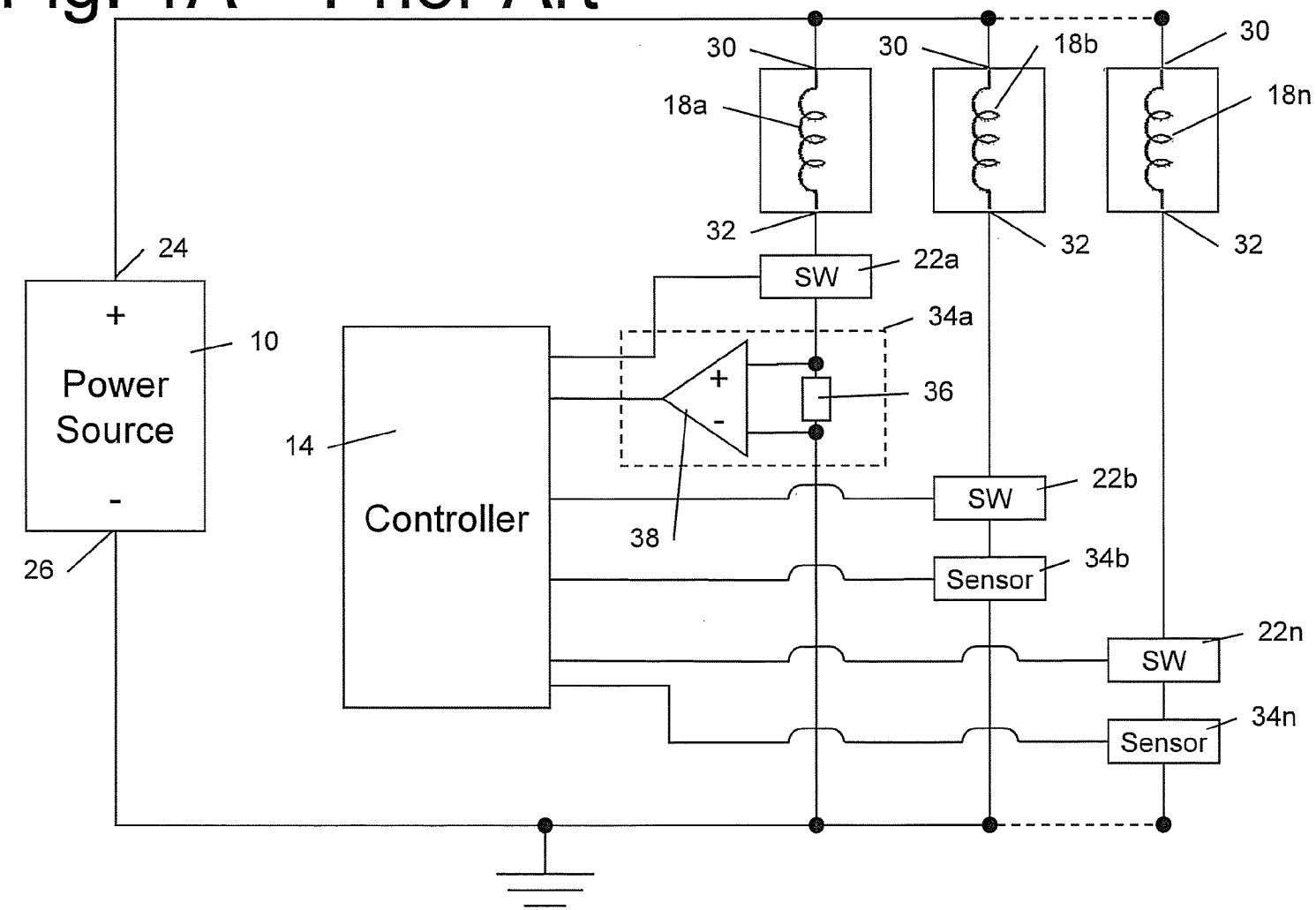
Fig. 1A – Prior Art

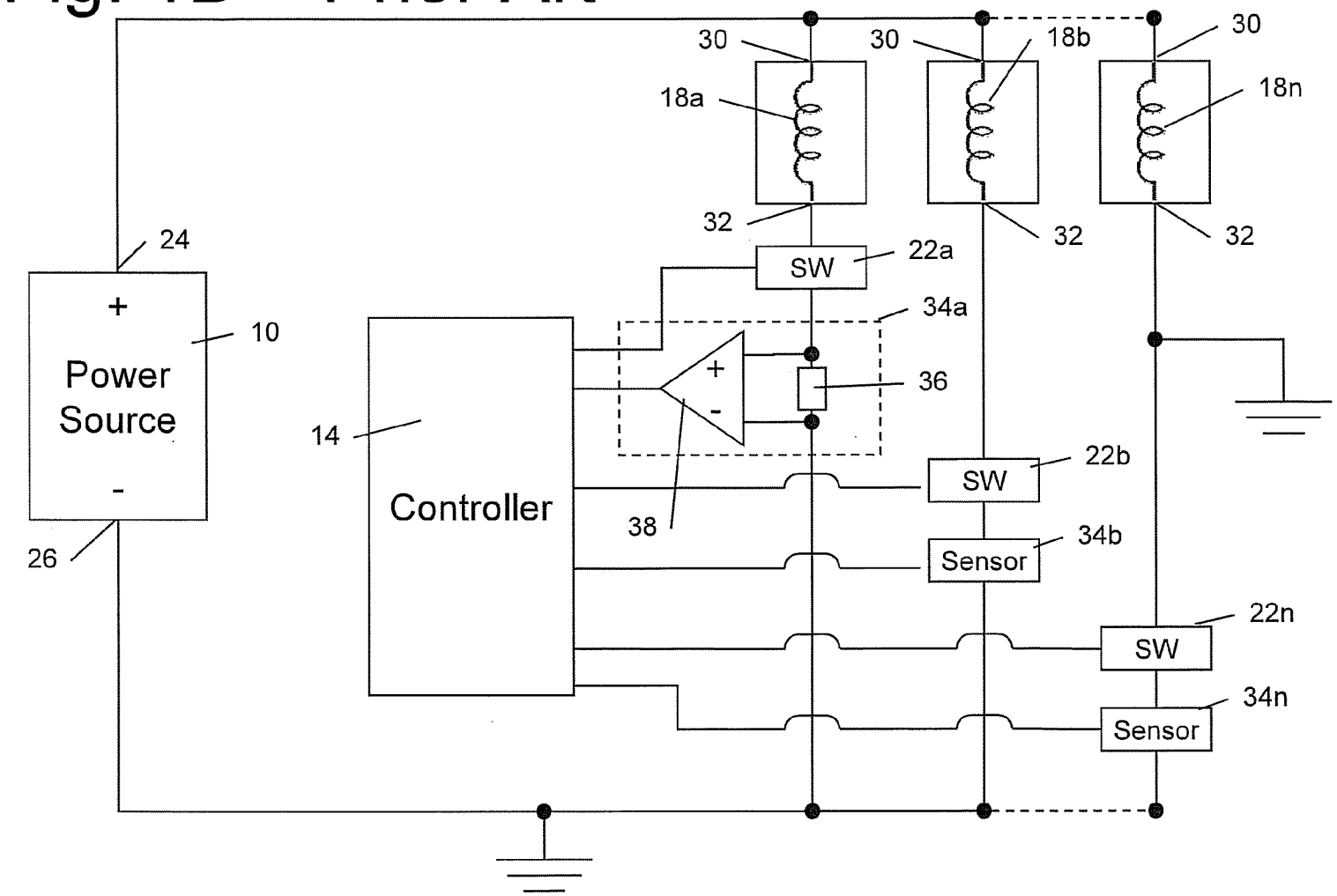
Fig. 1B – Prior Art

SOLENOID PROTECTION CIRCUIT

RELATED APPLICATIONS

The present application relates to and claims priority from U.S. Provisional Application No. 61/408,859, entitled "Solenoid Protection Circuit," filed Nov. 1, 2010, which is hereby incorporated by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to a system and method for protecting against the overheating of solenoids due to electrical faults.

Intermittently rated solenoids (i.e., of the type designed to be pulse operated) can overheat when they are inadvertently operated continuously. This can occur, for example, when a faulty control signal or an electrical short causes the solenoid to be continuously energized. Prior systems have attempted to address this issue by incorporating over-temperature protection within the windings of each solenoid in the circuit. This is not always possible due to space constraints—particularly where solenoids are tightly packed as the case in certain printers, such as drop on demand ink jet printers. This also adds significant cost and potential unreliability to a printer. Furthermore, this technique still risks high temperatures and potential damage to the solenoid before the over-temperature detection can trip out due to inherent thermal lags in this type of protection.

FIG. 1A is schematic of a prior art solenoid control and protection system. The system includes a power supply 10, a controller 14, a plurality of solenoids 18*a*-18*n* and a plurality of solenoid control switches 22*a*-22*n*. The power source 10 produces a predetermined voltage across its terminals 24, 26. The solenoids 18*a*-18*n* are connected in parallel across the terminals 24, 26 of the power source 10 for receiving power therefrom. In this regard, each solenoid 22*a*-22*n* has a respective coil having a first terminal 30 coupled to the supply terminal 24 of the power source 10 and a second terminal 32 coupled to the return terminal 26 of the power source 10 through a respective control switch 22*a*-22*n*. The controller 14 energizes/deenergizes the solenoids 18*a*-18*n* by connecting/disconnecting the solenoids to/from the power source 10 via the switches 22*a*-22*n*.

The system also includes a plurality of current sensors 34*a*-34*n*, each of which is connected downstream of a respective control switch 22*a*-22*n* for detecting a current flow through a respective solenoid 18*a*-18*n* and producing a signal responsive thereto. Each current sensor 34*a*-34*n* includes a resistor 36 and a differential amplifier 38. The resistor 36 is connected between a respective solenoid control switch 22*a*-22*n* and the return terminal 26 of the power source 10. The inputs of the amplifier 38 are connected across the resistor 36. The output of the amplifier produces a voltage (signal) indicative of the voltage across the resistor 36, and, hence, the level of current flowing through the resistor 36.

The controller 14 is coupled to the current sensors 34*a*-34*n* for receiving the outputs of the amplifiers 38. The controller 14 processes these signals to detect certain faults in the system. For example, an open circuit may occur between a solenoid and its respective control switch. The controller 14 can detect such an open circuit, e.g., by detecting the lack of current flow when the switch is closed. While the system of FIG. 1 can detect some faults, it is still possible for certain faults to go undetected and result in undesirable solenoid overheating. For example, if the second terminal 32 of a solenoid shorts to ground (e.g., to a printer chassis), the corresponding switch and sensor will be bypassed and the solenoid will be permanently energized with complete loss of control. This is shown in FIG. 1B, where the solenoid 18*n* is shorted to ground.

BRIEF SUMMARY OF THE INVENTION

Certain aspects of the present invention relate to a protection system for use with a solenoid circuit of the type that has solenoids connected across a power supply. The protection system includes a master switch connected between the power source and the solenoids for simultaneously connecting and disconnecting all of the solenoids from the power source. A current sensor is connected between the master switch and the solenoids for detecting a current flowing between the switch and any of the solenoids and for producing a current-sensed signal. A controller detects abnormalities based on the current-sensed signal and responsively opens the master switch to disconnect all of the solenoids from the power source.

BRIEF DESCRIPTION OF SEVERAL VIEWS OF THE DRAWINGS

FIG. 1A is schematic diagram of a prior art solenoid control and protection system.

FIG. 1B illustrates a fault which is not detectable by the system of FIG. 1A.

DETAILED DESCRIPTION OF THE INVENTION

Figure 2:
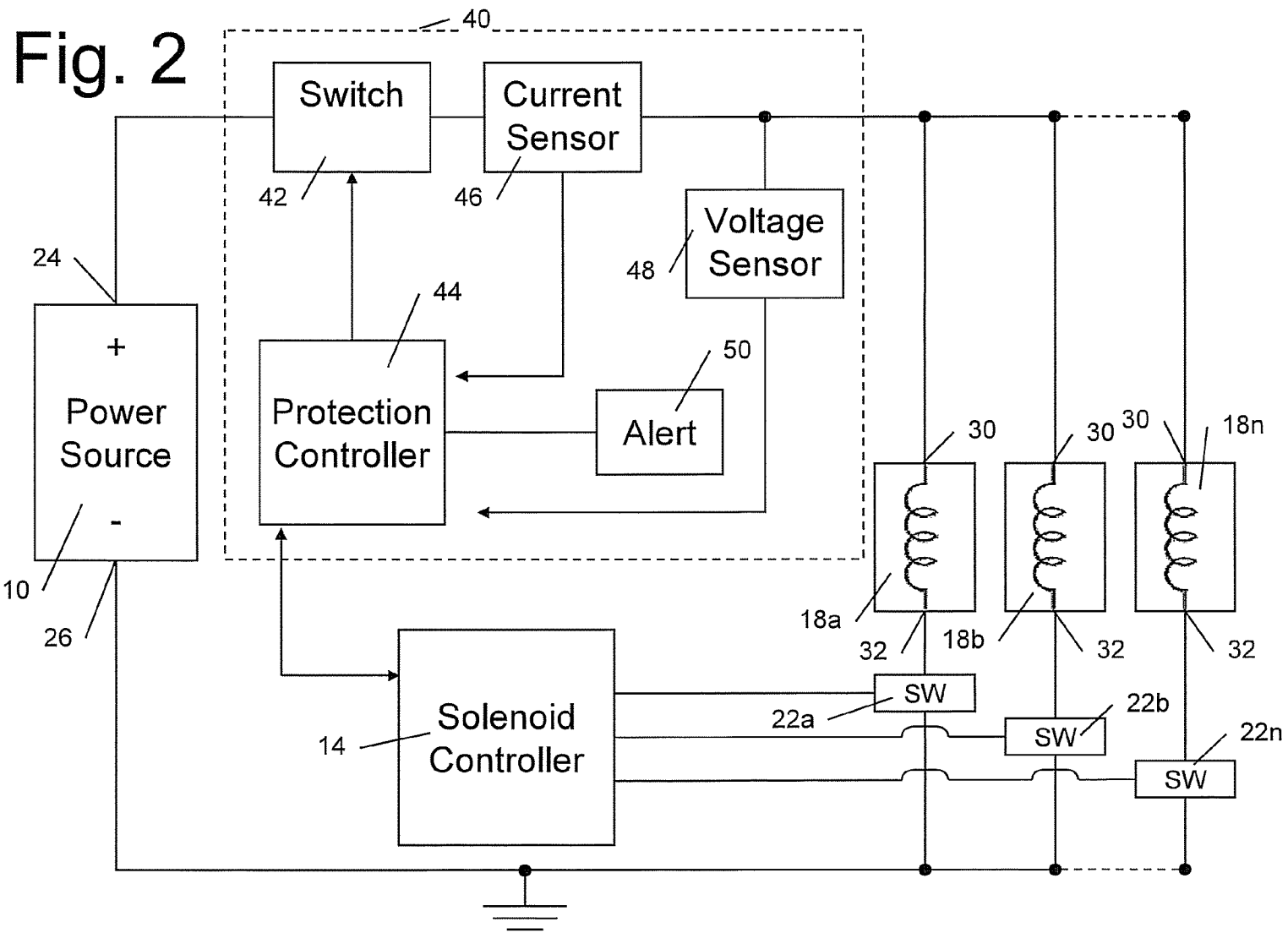
FIG. 2 is a schematic diagram of an embodiment of a protection system according to an embodiment of the invention.

Referring now to the drawings, FIG. 2 is a schematic diagram illustrating embodiment of a solenoid protection system 40 according to an embodiment of the invention, where the protection system is incorporated into a solenoid control system of the type that was discussed above in connection with FIG. 1A. The same reference numerals have been used to indicate like components in FIGS. 1A and 2. The solenoid protection system 40 is configured for connection between source terminal 24 of the power source 10 and the commonly connected first terminals 30 of the solenoids. Because the solenoid protection system 40 connects upstream of the solenoids 18*a*-18*n*, a single protection system can be used to detect faults in any of the solenoids and disconnect the solenoids from the power source to prevent the solenoids from overheating. In the illustrated embodiment the control switches 22*a*-22*n* are connected downstream of the solenoids

18*a*-18*n*. It will be understood, however, that the protection system 40 does not require the control switches 22*a*-22*n* to be placed at this location. For example, the protection system 40 can also be used when some or all of the control switches 22*a*-22*n* are placed between the solenoids 18*a*-18*n* and the source terminal 24. In such instances, the protection system 40 is connected upstream of the control switches 22*a*-22*n*. In addition, although not shown, the protection system 40 may be used in conjunction with the sensors 34*a*-34*n* of FIG. 1A.

The solenoid protection system 40 in FIG. 2 includes master switch 42, a controller 44 and a current sensor 46. The master switch 42 is connected between the supply terminal 24 and the first terminals 30 of the solenoids 18*a*-18*n* for simultaneously connecting and disconnecting all of the solenoids with the power source 10. Such placement advantageously allows a single switch 42 to be used to simultaneously disconnect all of the solenoids 18*a*-18*n* from the power source 10 in the event a fault is detected by the controller 44.

The current sensor 46 is shown connected between the master switch 42 and the first terminals 30 of the solenoids 18*a*-18*n*. It should be noted that the current sensor 46 will work equally well when positioned between the Switch 42 and the power source 10. The current sensor 46 detects a current flowing from the power source 10 to any of the solenoids 18*a*-18*n* and produces a current-sensed signal. In one embodiment, the sensor produces the current-sensed signal when the detected current exceeds a predetermined current threshold.

The controller 44 is configured to detect an abnormality based on the current-sensed signal, and to deactivate/open the master switch 42 when an abnormality is detected. For example, the controller can be configured to open the master switch 42 when the current-sensed signal is present at a time when the solenoids 18*a*-18*n* are all supposed to be deenergized. This can be accomplished, for example, by sensing presence of the current-sensed signal in the absence of any solenoid control signals. This situation can occur, for example, when a solenoid is shorted to ground as shown in FIG. 1B.

The solenoid protection system 40 can also include a voltage sensor 48 for sensing a voltage across at any location between the master switch 42 and terminal 30 of the solenoids 18*a*-18*n* and producing a voltage-sensed signal in response thereto. The voltage sense location may be optionally between the switch 42 and the current sensor 46. In one embodiment, the voltage sensor 48 produces the voltage-sensed signal when the detected voltage exceeds a predetermined threshold.

The controller 44 is configured to detect an abnormality based on the voltage-sensed signal, and to deactivate/open the master switch 42 when an abnormality is detected. For example, the controller 44 can open the master switch 42 when the voltage-sensed signal is present at a time when the master switch is supposed to be open. This can be accomplished, for example, by sensing presence of the voltage-sensed signal when no control signal is being sent to the master switch. This can occur, for example, if the master switch 12 fails to its closed position. When this occurs, the controller 44 can further disable the solenoids, e.g., by sending a disabling signal to the solenoid controller 14 that controls all of the solenoid switches 22*a*-22*n*.

The controller 44 can be configured to actuate an alert indicator 50 when an abnormality is detected. The indicator 50 can provide an audible and/or visual indication that an abnormality has been detected. A suitable indicator can take a variety of forms, as will be apparent to those skilled in the art. For example, the indicator can be a display screen, a speaker, a light or series of lights, etc.

Figure 3:
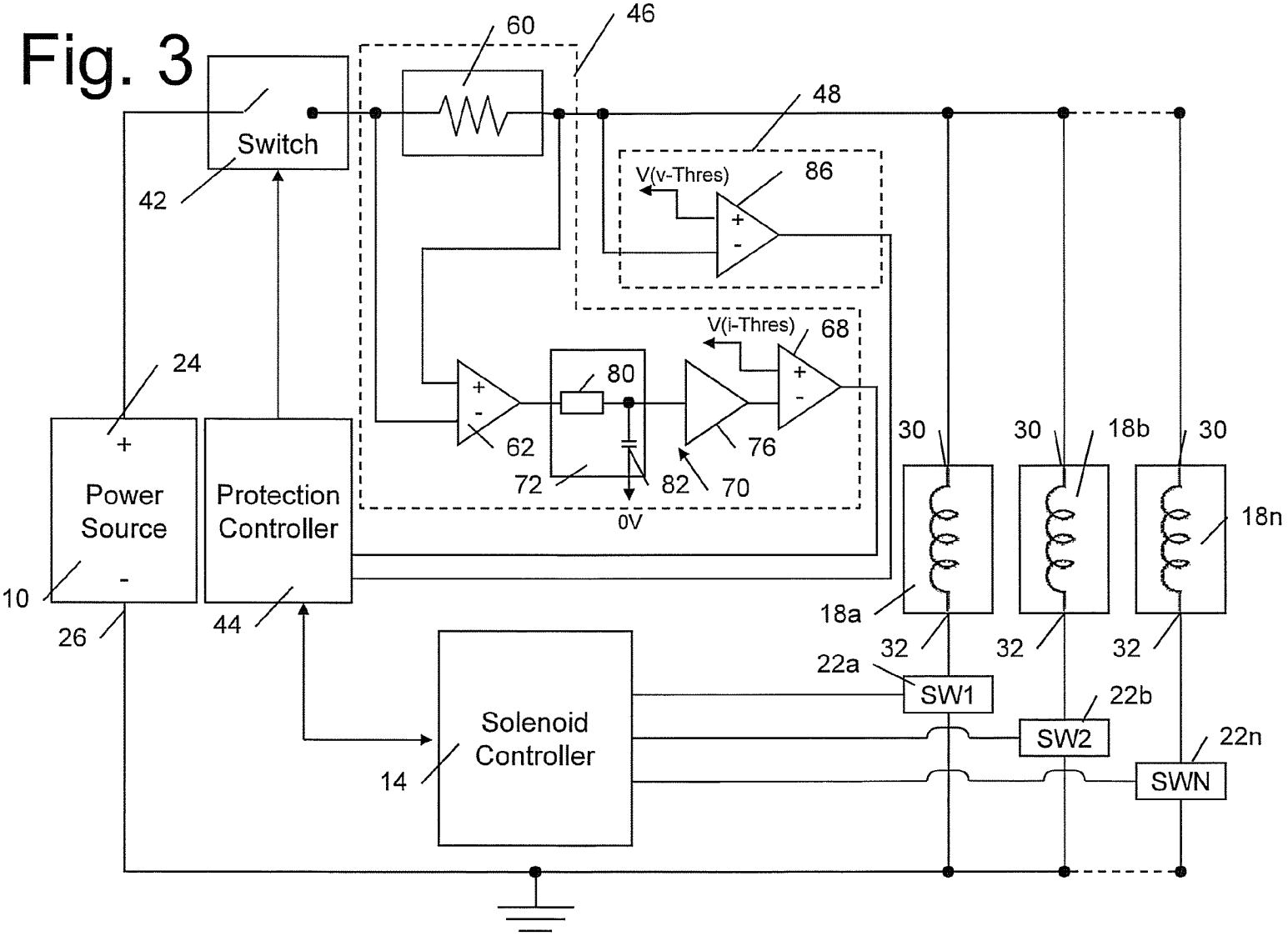
FIG. 3 is a schematic diagram illustrating certain aspects of FIG. 2 in greater detail.

FIG. 3 illustrates the protection systems of FIG. 2 in greater detail. As shown in FIG. 3, the current sensor 34 comprises a resistor 60 connected between the master switch 42 and the first terminals 30 of the solenoids 18*a*-18*n*. An amplifier/level shift circuit 62 has its inputs connected across the resistor 60. The output of the amplifier/level shift circuit produces a signal (voltage) indicative of the voltage across said resistor 60, and hence, the level of current flowing through the resistor. This amplifier/level shifter amplifies the small voltage across resistor 60 and then shifts this amplified signal so that it is referenced to 0V. This is a technique well known to those skilled in the art. A comparator 68 has one input connected to a reference voltage $V_{i\text{-}Threshold}$ and a second input connected to the output of the amplifier/level shifter 62 through a conditioning circuit 70. The conditioning circuit 70 comprises a filter 72 and a second amplifier 76. The filter 72 includes a resistor 80 and capacitor 82. The output of the comparator 68 is connected to an input of the protection controller 44. The comparator 68 outputs a signal, i.e., the current-sensed signal, when the voltage at its second input exceeds the reference voltage ($V_{i\text{-}Threshold}$). The controller is configured to detect an abnormality based on the current-sensed signal, and to deactivate/open the master switch 42 when an abnormality is detected in any one or more solenoids. For example, the controller 44 can open the master switch 42 when the current-sensed signal is present at a time when none of the solenoids are supposed to be energized, i.e., none of the solenoid control switches 22*a*-22*n* are closed. This can be accomplished when the current-sensed signal is detected in the absence of any solenoid control signals. This can occur, for example, when a solenoid is shorted to ground as shown in FIG. 1B or if any of the normal solenoid control switches 22*a*-22*n* goes either short circuit or fails with low resistance across it.

Hence, the protection system 40 monitors for current flow from the power supply 10 to the solenoids 18*a*-18*n* when none of the solenoids are supposed to be energized. If current flow above a predetermined threshold is detected when none of the solenoids are being driven, then power to the solenoids is cut by opening the switch 42 placed between the power supply 10 and the positive supply connection to all solenoids.

As will be appreciated, the various components and thresholds will depend on the specific application. By way of non-limiting example, if the power source 10 provides a supply voltage of 36 volts and the solenoids 18*a*-18*n* each has a resistance of 72 ohms, the maximum current flow normally is 0.5 A. In such an application, the threshold ($V_{i\text{-}Threshold}$) is set somewhere below 0.5 A. In some applications, the current may be regulated to a lower level (e.g., 0.2 A) once the solenoid is "pulled in," e.g., by using a pulse-width-modulation (PWM) voltage switching technique, as is common in the art. In such instances, the threshold ($V_{i\text{-}Threshold}$) is set below 0.2 A. For example, the threshold can be set to 0.1 A.

The current sensor 46 should be capable of withstanding a large overdrive since when a plurality of solenoids are energized at the maximum current level for each solenoid there will be a much larger current flowing e.g. for 16 solenoids simultaneously switching this will result in a current flow of $16 \times 0.5 = 8$ A for the system described above.

The resistor 60 is sized to detect low-level currents flowing between the power source 10 and the solenoids 18*a*-18*b*. For example, when the threshold is set to 0.1 A, a 0.05-ohm resistor can be used.

In the illustrated embodiment, the amplifier 62 is in the form of a differential amplifier/level shift circuit, which amplifies the voltage drop across the resistor 60 (e.g. ×10) and references this voltage to 0 Volts. This voltage is then passed through the filter 72 to reduce noise in the signal. The level of filtering will depend on the specific application. In the context of the present example, 1 ms filter may be used, for example. The filter 72 is beneficial, particularly in noisy industrial applications, because the voltage sensed across the resistor 60 is relatively small (e.g., a few mV in the present example.) The filtered signal is then buffered and further amplified (e.g., ×10 to give an overall gain of ×100) by the second amplifier 76.

The amplified current signal is then compared to a preset threshold ($V_{i\text{-}Threshold}$) at the comparator. This threshold level is chosen to correspond to a current that is significantly less than the lowest single solenoid operating current level. In the illustrated example, this threshold can be set to correspond to a current of 100 mA through the resistor 60. Hence, if the sensing resistor is 0.05 ohm, the threshold will be 0.5 V:

$$V_{i\text{-}Threshold}=0.1\text{ A}\times 0.05\text{ ohm}\times 100=0.5\text{V}.$$

As mentioned above, the protection circuit 40 may also include a voltage sensor 48. As shown in FIG. 3, the voltage sensor 48 may comprise a second comparator 86 having one input connected to a predetermined threshold ($V_{V\text{-}Threshold}$) and its other input connected to sense a voltage downstream of the switch 42. The comparator 86 produces a signal (voltage) when the sensed voltage exceeds this threshold ($V_{v\text{-}Threshold}$). The voltage threshold may be set to correspond to a voltage that is between zero and the voltage normally output by the power source. This voltage-sensed signal is delivered to an input of the controller 44. This signal can be used to enable detection of a fault in either the master switch 42 or protection controller electronics 44. For example, the presence of the voltage-sensed signal when the master switch 42 is supposed to be open indicates that the master switch has failed in its closed position. Conversely, absence of the voltage-sensed signal when the master switch 42 is supposed to be closed indicates that the master switch has failed to its open position.

It will be appreciated that the various components of the circuit 40 could be modified without departing from the scope of the invention. For example, some of the functions performed by the comparators could be performed by software and/or logic within the controller 44. Likewise, while the solenoid controller 14 and protection controller 44 are illustrated as separate units, they could also be embodied in a single controller. Also it is possible that the current sense function may be performed using a Hall Effect sensor which would have the advantage of not needing a low value resistor and differential amplifier/level shift circuit. However at the time of writing these Hall sensors are not sufficiently accurate to achieve a reliable small current detection capability without significant potential temperature drift. This of course does not preclude this alternative current sense technique from being used as an alternative in the future as Hall Sensor technology is improved.

Figure 4A:
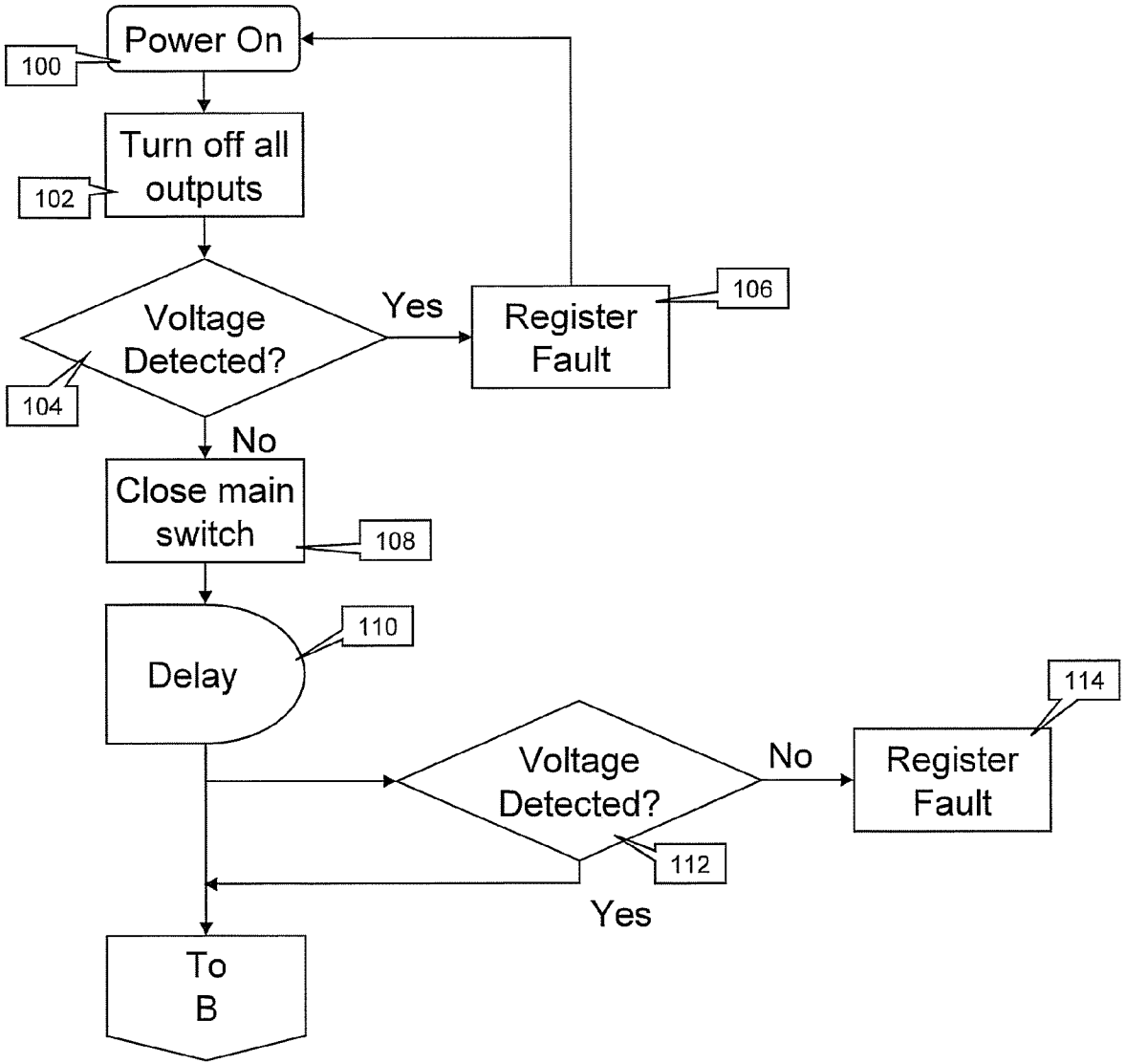
FIGS. 4A and 4B are a flow diagram illustrating exemplary steps of a solenoid protection method according to an embodiment of the invention.
Figure 4B:
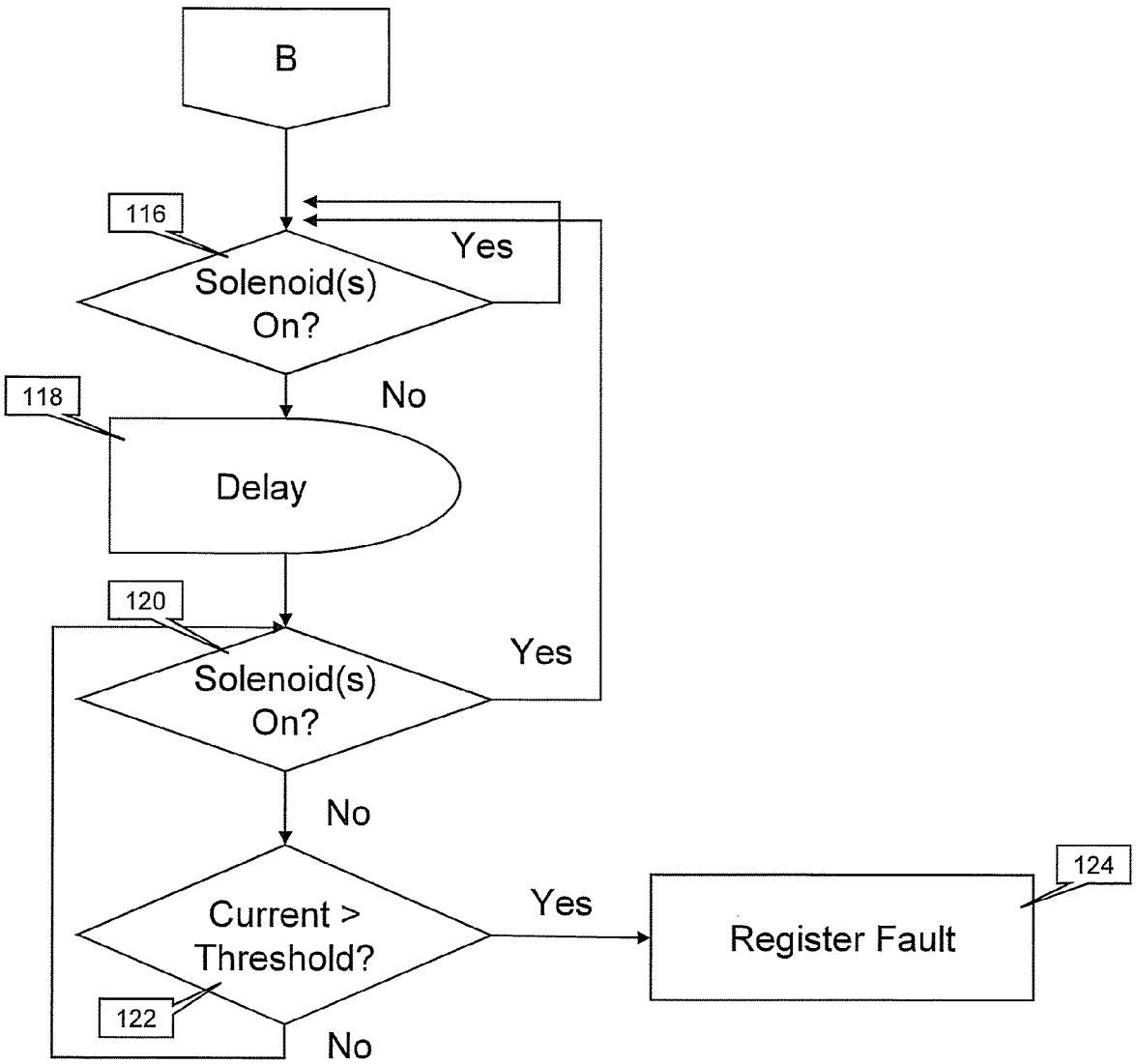

FIGS. 4A and 4B are a flow diagram illustrating exemplary steps of a solenoid protection method according to an embodiment of the invention. Initially, in Step 100 system is powered on. Next, in step 102, the controller(s) sets all outputs to off. For example, the outputs to the master switch 42 and the solenoid control switches 22*a*-22*n* are all turned off to open all of the switches. Next, in step 104 the process checks to see if a voltage is detected by the voltage sensor 48.

If a voltage is detected, control is passed to step 106 where a fault is registered, e.g., by setting a fault flag. In particular, the presence of a voltage when the switch 42 is inactive (off/open), indicates that the master switch 42 has failed to its closed position. In response to detection of a fault in step 106, the process disables all of the control outputs for the solenoids, thereby disabling the circuit and preventing the solenoids from being activated and possibly overheated if a further fault should occur. The process can also activate the indicator 50 to advise the user of the presence of a fault, including the specific fault that has been detected, e.g., failed master switch.

If no voltage (signal) is detected at step 104, control is passed to step 108. In step 108, the master switch 42 is closed to connect the power source terminal 24 to the solenoids 18*a*-18*n*.

Control is then passed to step 110. Step 110 delays further processing for a predetermined time to account for a switching delay in moving the master switch 42 to its closed position. This delay will depend on the particular system. An exemplary delay may be on the order of 1 ms although longer may be necessary if the switch 42 is likely to bounce when closed or if large reservoir capacitors are present in order to allow for these to be charged.

After the delay, control is passed to step 112 to determine if a voltage is detected by the voltage sensor 48. The absence of a voltage at step 112 (i.e., when the main switch is set to its closed position) indicates that main switch has malfunctioned. Hence, if no voltage is detected at step 112, control is passed to step 114 to register a fault, e.g., by setting a fault flag. Step 114 can also disable all of the solenoid control outputs and activate the indicator 50 to advise the user of the presence of a fault, including the specific fault that has been detected, e.g., failed master switch or short circuit present on solenoid system.

If voltage is detected in step 112, control is passed to step 116. In step 116, the process checks to determine if any of the solenoids 18*a*-18*n* are turned on. This can be accomplished by checking for the presence of the solenoid control signals, e.g., by checking their status in software or by actually sensing to see if the signals are being issued by the controller 14. Control continues to loop through step 116 as long as one or more of the solenoids is active. If no solenoids are active control is passed to step 118.

Step 118 delays further processing for a predetermined time to account for a switching delay in the time it takes current to dissipate from the circuit when the solenoids are turned off. This delay will depend on the particular system. An exemplary delay may be on the order of 10 ms but this will depend on the maximum current decay time in the solenoids.

Control is then passed to the block 120, where the process again checks to determine whether any of the solenoids are active. If one or more solenoids 18*a*-18*n* are active, control is returned to step 116. If no solenoids are active, control is passed to step 122, where the process checks for presence of the current-sensed signal. As noted above, the current-sensed signal is generated when the current through the sensing resistor 60 is above a predetermined value. The presence of the current-sensed signal when none of the solenoids 18*a*-18*n* are supposed to be energized indicates an abnormal condition, e.g., a short circuit across one of the solenoid control switches or a short circuit of any solenoid 18*a*-18*n* terminal 32 to chassis/0V potential. Thus, if the sensed current exceeds the threshold, control is passed to step 124 where a fault is registered, e.g., by setting a fault flag. Step 124 turns off the master switch and disables all of the solenoid outputs. Step 124 also causes issuance of a fault alert. For example, the controller can activate the indicator 50 to advise the user of the presence of a fault, including the specific fault that has been detected, e.g., short in solenoid circuit.

If however the current sensed in step 122 is below the threshold, control is returned to step 120.

Figure 5:
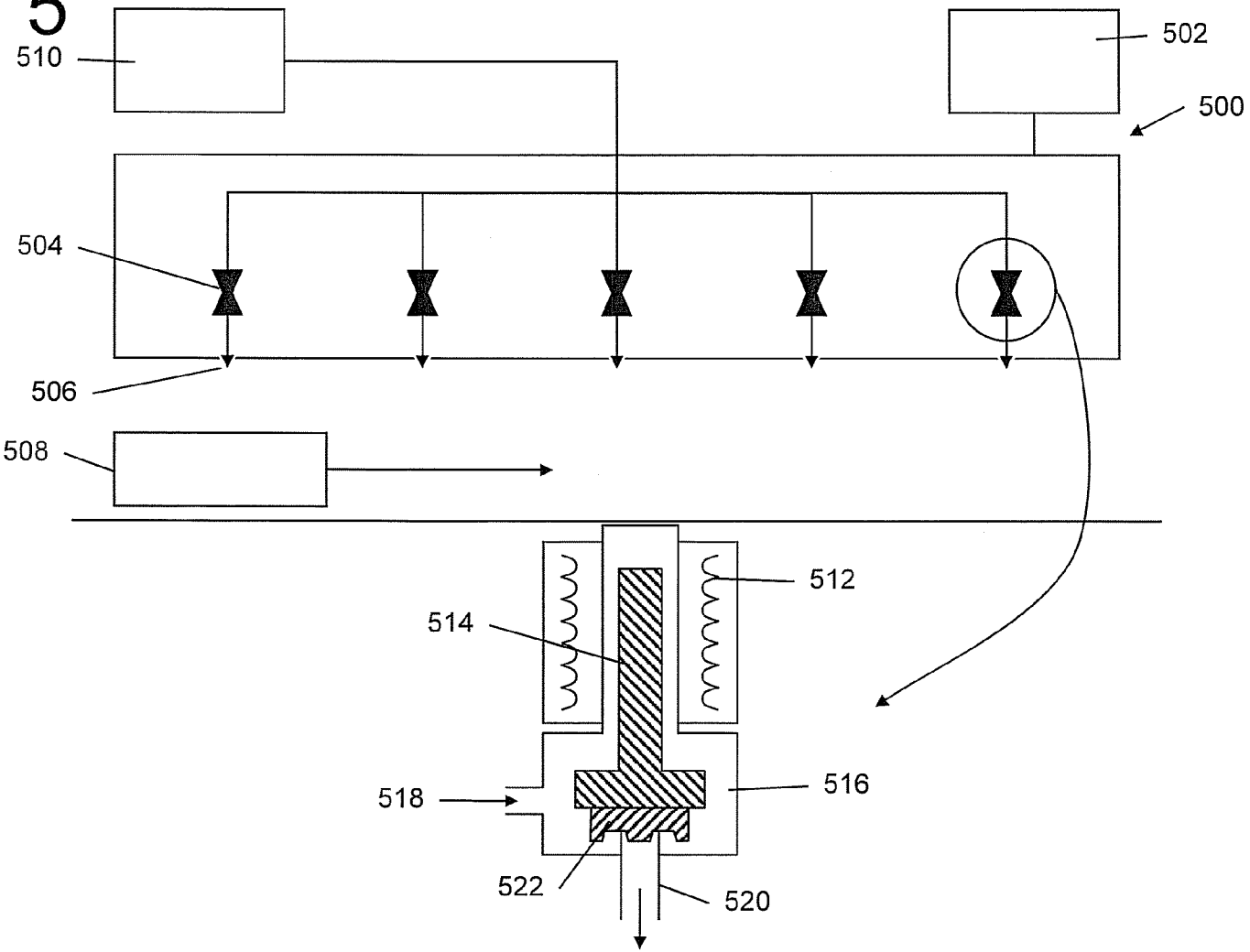
FIG. 5 is a schematic diagram of a drop on demand ink jet printer incorporating a solenoid protection system according to an embodiment of the invention.

The solenoid protection system has application, for example, in drop on demand ink jet printers. In this regard, FIG. 5 is a schematic of a drop on demand ink jet printer 500 incorporating a protection system according to an embodiment of the invention. The drop on demand ink jet printer 500 comprises an ink reservoir 502 operated under pressure which feeds ink to a bank of solenoid valves 504 each controlling the flow of ink to a nozzle 506 in a print head comprising an array of the nozzles. The print head is to apply droplets to packages 508 or other articles carried transversely past the print head. The valves 504 are operated in the desired sequence by a programmable controller 510 to apply the desired image, e.g. a bar code, alphanumeric symbol or other image, to the package. Such a printer can be of conventional design, construction and operation and many forms of such a printer are available commercially.

Each valve 504 comprises a coil 512 within which is reciprocably journalled a magnetisable plunger 514. The plunger 514 extends into a chamber 516 located at one end of the valve and into which ink is fed via inlet 518 from the reservoir 502 and from which ink can flow to the nozzle 506 through outlet 520. The plunger is normally urged into the valve closed position by a spring (not shown) so that a sealing disc 522 on the plunger bears against the rim of the outlet 520 when the valve is in the closed position (deengergized).

Further details of exemplary printers can be found, for example, in U.S. Pat. No. 4,928,111, the disclosure of which are hereby incorporated by reference. The solenoid protection system 40 of the present invention can be incorporated in the printer to prevent overheating of the solenoid controlled valves in the manner described above. In this regard, the protection controller 44 may be formed integrally with or separately from the controller 510. The switch 42 and sensors 46, 48 are connected between the power source (not shown) and the solenoid valves 504 in the manner described above.

In an embodiment of the invention, a machine-readable storage may be provided, having stored thereon, a computer program having at least one code section executable by a machine, thereby causing the machine to perform the steps described herein for preventing solenoid overheating.

Accordingly, certain aspects the present invention may be realized in hardware, software, or a combination of hardware and software. Certain aspects of the present invention may be realized in a centralized fashion in at least one computer system, or in a distributed fashion where different elements are spread across several interconnected computer systems. Any kind of computer system or other apparatus adapted for carrying out the methods described herein is suited. A typical combination of hardware and software may be a general-purpose computer system with a computer program that, when being loaded and executed, controls the computer system such that it carries out the methods described herein.

Certain aspects of the present invention may also be embedded in a computer program product, which comprises all the features enabling the implementation of certain methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

The invention claimed is:

1. A protection system for a solenoid circuit of an ink jet printer, the solenoid circuit having a plurality of solenoid valves connected across a power supply and a plurality of switches for controllably connecting and disconnecting the solenoid valves to and from the power source, the apparatus comprising;

a master switch connected between the power source and the solenoid valves for simultaneously connecting and disconnecting all of the solenoid valves with the power source;

a current sensor positioned between the power source and the solenoid valves for detecting a current flowing between the power source and any of the solenoid valves and for producing a current-sensed signal;

a controller configured to detect an abnormality based current-sensed signal and to responsively open the master switch, thereby disconnecting all of the solenoid valves from the power source.

2. The apparatus of claim 1, wherein the current sensor produces the current-sensed signal in response to the current-sensed exceeding a predetermined threshold.

3. The apparatus of claim 2, wherein the controller detects an abnormality in response to the presence of the current-sensed signal when none of the solenoid valves are supposed to be active.

4. The apparatus of claim 2, wherein the current sensor comprises:

a resistor connected between the master switch and the solenoid valves; and a differential amplifier having its inputs connected across the resistor and an output that produces a signal indicative of the level of current flowing through the resistor.

5. The apparatus of claim 4, further comprising a comparator having a first input connected to the output of the differential amplifier, a second input connected to receive a voltage indicative of the predetermined current threshold, and an output that indicates if the first input signal exceeds this predetermined current threshold.

6. The apparatus of claim 5, further comprising signal conditioning and an amplifier connected between the output of the differential amplifier and the first input of the second comparator.

7. The apparatus of claim 1, further comprising a voltage sensor for detecting a voltage at a location between the master switch and solenoid valves and producing a voltage-sensed signal in response thereto; and wherein the controller is further configured to detect an abnormality based voltage-sensed signal.

8. The apparatus of claim 7, wherein the controller is further configured to open the master switch in response to detecting an abnormality based on the voltage sensed signal.

9. The apparatus of claim 7, wherein the controller is configured to detect an abnormality in response to the presence of the voltage-sensed signal at a time when the master switch is supposed to be open.

10. The apparatus of claim 7, wherein the controller is configured to detect an abnormality in response to the absence of the voltage-sensed signal at a time when the master switch is supposed to be closed.

11. An apparatus comprising:

a power supply having a supply terminal and a return terminal;

a plurality of solenoid valves, each solenoid valve having a coil with respective first and second terminals;

a master switch connected between the supply terminal of power source and the first terminals of the solenoid valve coil for simultaneously connecting and disconnecting all of the solenoid valves with the power source supply terminal;

a plurality solenoid valve control switches, each switch being connected between the second terminal of a respective one of the solenoid valve coils and the power source return terminal for controllably connecting and disconnecting a respective solenoid valve coil with the power source return terminal;

a current sensor that senses current anywhere between the supply terminal of the power supply and the first terminals of the solenoid valves for detecting a current flowing between the supply terminal of the power source and any of the solenoid valves and for producing a current-sensed signal;

a controller configured to detect an abnormality based on the current-sensed signal, and to open the master switch in response to the detected abnormality, thereby disconnecting all of the solenoid valves from the power source.

12. The apparatus of claim 11, wherein the current sensor produces the current-sensed signal in response to the sensed current exceeding a redetermined threshold.

13. The apparatus of claim 12, wherein the controller detects an abnormality in response to the presence of the current-sensed signal when none of the solenoid valves are supposed to be active.

14. The apparatus of claim 12, wherein the current sensor comprises:

a resistor connected in the circuit anywhere between the supply terminal of the power supply and the first terminals of the solenoid valves coils; and a differential amplifier having its inputs connected across the resistor and an output that produces a signal indicative of the level of current flowing through the resistor.

15. The apparatus of claim 14, further comprising a comparator having a first input connected to the output of the differential amplifier, a second input connected to receive a voltage indicative of the predetermined current threshold, and an output that produces a signal indicative of the voltage difference between the first and second inputs.

16. The apparatus of claim 15, further comprising an amplifier connected between the output of the differential amplifier and the first input of the comparator.

17. The apparatus of claim 15, further comprising a voltage sensor for detecting a voltage at any location between the master switch and first terminals of the solenoid valve coils and producing a voltage-sensed signal in response thereto; and wherein the controller is further configured to detect an abnormality based voltage-sensed signal.

18. The apparatus of claim 17, wherein the controller is further configured to open the master switch in response to detecting an abnormality based on the voltage sensed signal.

19. The apparatus of claim 17, wherein the controller is configured to detect an abnormality in response to the presence of the voltage-sensed signal at a time when the master switch is supposed to be open.

20. The apparatus of claim 17, wherein the controller is configured to detect an abnormality in response to the absence of the voltage-sensed signal at a time when the master switch is supposed to be closed.

21. A method of detecting an abnormality in a circuit of the type comprising a power supply having a supply terminal and a return terminal; a plurality of solenoid valves, each solenoid valve having a first terminal connected to the power source supply terminal and second terminal connected to the power source return terminal through a respective control switch, the method comprising;

detecting an abnormality by sensing for current flowing between the power source and the solenoid valves at a time when the solenoid valves are not supposed to be energized; and disconnecting all of the solenoid valves from the power source supply terminal when an abnormality is detected.

22. The method of claim 21, further comprising positioning a switch between the power supply source terminal and the first terminals of the solenoid valves and opening the switch when an abnormality is detected.

* * * * *